United States Patent [19]

Hung

[11] Patent Number: 4,832,355

[45] Date of Patent: May 23, 1989

[54] MULTI-FUNCTION RACK STRUCTURE FOR CARRYING A JACK

[76] Inventor: Michael Hung, 11th Fl., 624 Ming Chuan E. Road,, Taipei, Taiwan

[21] Appl. No.: 190,652

[22] Filed: May 5, 1988

[51] Int. Cl.[4] ..... B25H 5/00

[52] U.S. Cl. ..... 280/32.5; 182/33; 280/79.2; 280/79.4; D6/335; D6/336

[58] Field of Search ..... 108/144; 182/33; 248/188.2; D6/350, 353, 335, 336; D3/30.5; 211/175, 187; 280/32.5, 32.6, 638, 35, 47.35, 47.38, 47.41, 79.1 A, 79.2

[56] References Cited

U.S. PATENT DOCUMENTS

| | | | |
|---|---|---|---|
| D. 110,227 | 6/1938 | Stoll | D6/353 |
| D. 276,861 | 12/1984 | Keddie | D6/336 |
| D. 287,434 | 12/1986 | Wolfe et al. | D6/336 |
| D. 295,001 | 4/1988 | Ferdinand et al. | D6/336 |
| 2,201,420 | 5/1940 | Zschau | 280/79.1 A |
| 4,624,341 | 11/1986 | Lee | 182/15 |

*Primary Examiner*—Charles A. Marmor
*Assistant Examiner*—Michael Mar
*Attorney, Agent, or Firm*—Wenderoth, Lind & Ponack

[57] ABSTRACT

It is a multi-function rack structure for carrying a jack, and the rack mainly comprises a chassis, a seat and tool racks. The seat is fixed on one end of the chassis; the bottom of the chassis is provided with casters, while the top surface of the chassis is furnished with grooves in a specific arrangement. There is a sufficient space between the chassis and the seat for mounting a given type of jack. The grooves can also be used for holding repair tools. One side of the seat can be provided with a tool rack for holding necessary tools. By means of the aforesaid structure, a device can be formed for carryng a jack, be used as a tool and parts tray, a working rack, a stool or footstool, etc.

6 Claims, 4 Drawing Sheets

MULTI-FUNCTION RACK STRUCTURE FOR CARRYING A JACK

FIELD OF THE INVENTION

This invention relates to a structure for carrying a jack, and more particularly it relates to a device which can normally be used for packing a jack, and can also be used for placing tools and parts thereon after the jack has been removed, or used as a working rack, a seat or a footstool.

BACKGROUND OF THE INVENTION

Normally, a jack is a weight-lifting tool being used widely for many purposes; especially, it is a indispensable tool for use in mechanical repair and assembling operations. A small type of jack not only is used in a specific working site, but it is also widely used in routine car maintenance work or in emergency repair work because of its portable nature; therefore, almost every car is provided with a jack. A small type of jack is capable of lifting 2,000 lbs to 4,000 lbs, and its weight is only from several lbs to several tens of lbs. The manufacturer usually packs such type of jack in a cardboard box having a given size; such cardboard box is merelyused for packing that kind of jack without being used for other purposes.

SUMMARY OF THE INVENTION

In view of the drawback of the conventional jack packing container, the inventor has developed a multi-function rack structure for carrying a jack, and it mainly comprises a chassis, a seat, and tool racks. The bottom portion of the chassis is provided with casters, while the top surface of the chassis is furnished with specific grooves for holding a jack and the related tools and parts. The top of the chassis is provided with square abutments to be connected with the seat so as to hold the jack in place. The seat may also be used as a stool, or a working rack, or a footstool. A tool rack is also mounted at one side of the seat for holding repair tools; therefore, the present invention is substantially a multi-function structure for packing a jack, holding tools and parts, and being used as a working rack, and a footstool, etc.

DESCRIPTION OF THE PREFERRED EMBODIMENT

Figure 1:
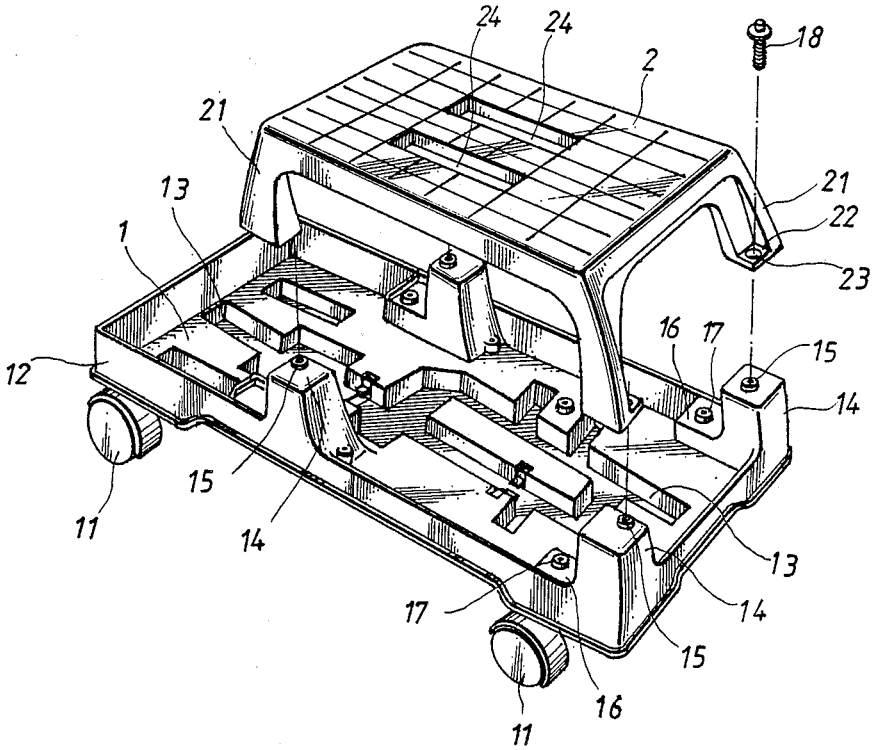
FIG. 1 is a perspective exploded view of a first embodiment according to the first embodiment of the present invention.
Figure 2:
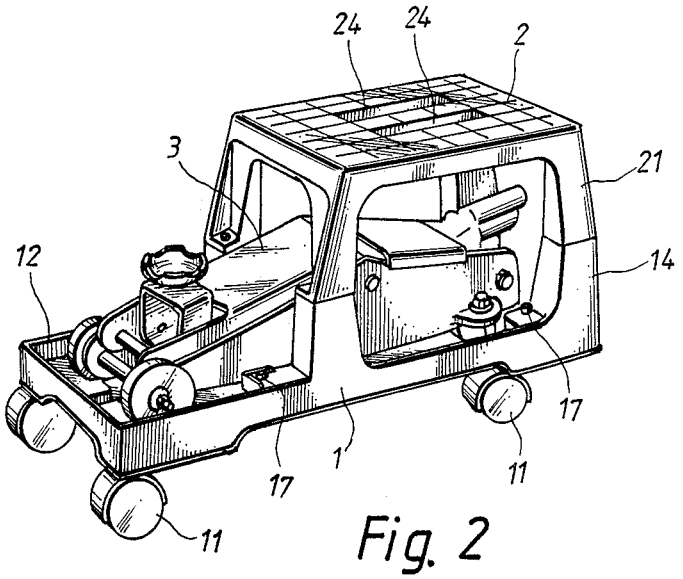
FIG. 2 is a perspective view of the present invention after being assembled in one condition.
Figure 3:
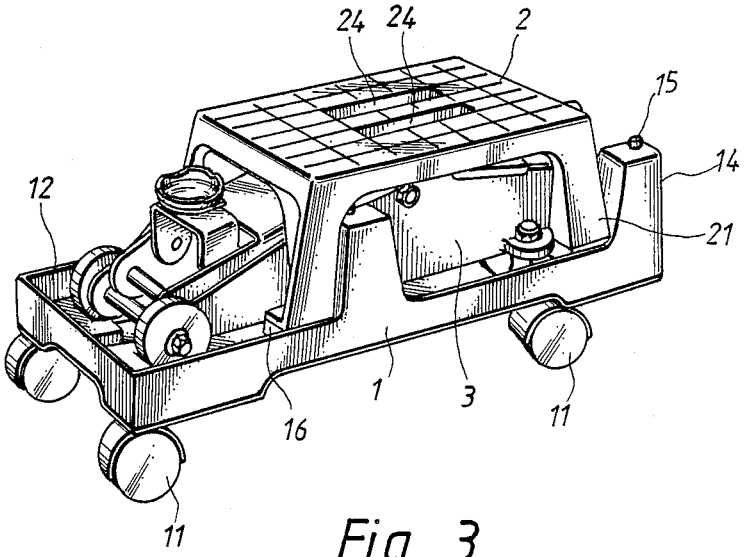
FIG. 3 is a perspective view of the first embodiment of the present invention after being assembled in a second condition.

Referring to FIG. 1, there is shown a rack structure according to the present invention, which mainly comprises a chassis 1 and a seat 2, At four corners of the under side of the chassis 1 are mounted four casters 11 respectively. The chassis 1 is furnished with wall 12 around the four sides thereof; the top surface of the chassis 1 is provided with several grooves 13, and four abutments 14 at the corners of a rectangle, each of which has a round stud 15 on the top thereof. Beside the corresponding side of each of the abutments 14, there is a flat plane surface 16, which has a round stud 17 with an internally threaded hole. The seat 2 has four legs 21 under its four corners. The lower end of each leg 21 has a flange portion 22 with a round hole 23 therein. Each of the round holes 23 on the legs 21 can be exactly mounted over corresponding round stud 15 of the square abutment 14, or over the round stud 17 on a plane surface 16 and fixed in place with a screw 18 and a washer. The seat 2 is furnished with one set of parallel through slots 24. An the grooves 13 on the top surface of the chassis 1, a suitable type of jack 3 and some related tools can be fitted and stored; then, the seat 2 is mounted over the chassis 1 by mating the round holes 23 of the legs 21 with the round studs 15 respectively before and then being fixed in place with screws 18 that are mounted in the threaded holes of the round studs 17. In that case, the whole rack will be in a ready shipping condition as shown in FIG. 2, and can also be moved on a floor surface by means of the casters 11, or can be carried by hand by holding the through slots 24. After the jack 3 is removed from the chassis 1, the seat 2 may be mounted over the chassis 1 to form an assembly to be used as a stool, or a working rack, or a footstool. After the jack 3 has been removed from the chassis 1, the grooves 13 thereon may be used as a tool rack or parts tray. FIG. 3 illustrates another condition embodiment of the present invention, in which the seat 2 is mounted on the four plane surface 16 by means of screws 18. The function is the same as that shown in FIG. 2 except the seat is at a lower height.

Figure 4:
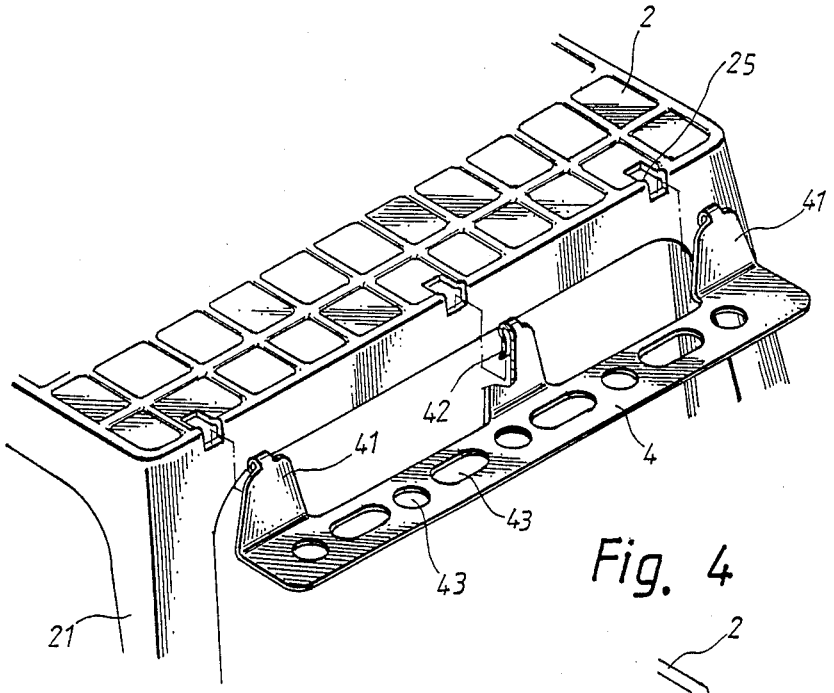
FIG. 4 is a perspective view of an embodiment of a tool rack which can be added to the structure of the present invention.

FIG. 4 shows one side of the seat 2 provided with a tool rack 4. The seat 2 has several holes 25 for receiving the hooks 42 of the fitting pieces 41 on the tool rack 4. The tool rack 4 is provided with a plurality of through holes 43 arranged for inserting tools either for storage or use purpose.

Figure 5:
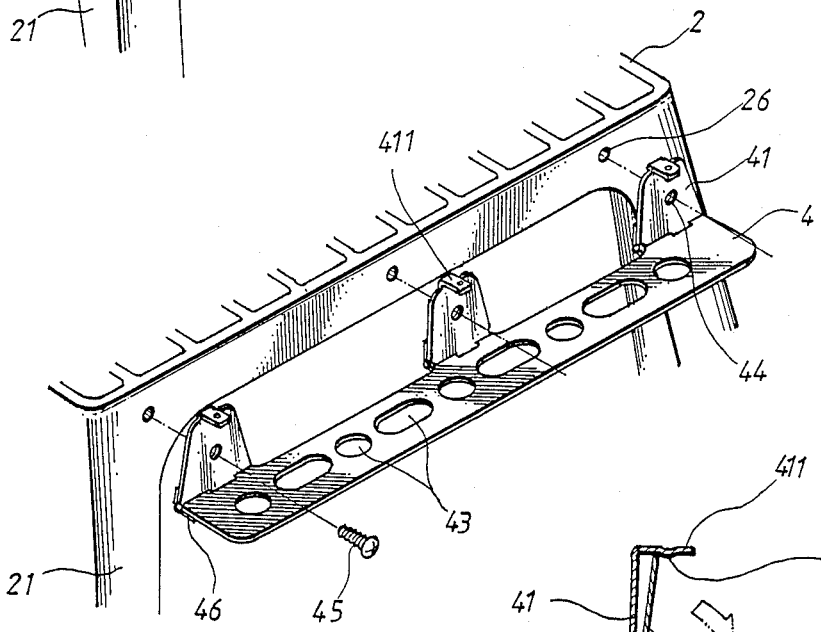
FIG. 5 is a perspective view of a further embodiment of the tool rack similar to that shown in FIG. 4.
Figure 5A:
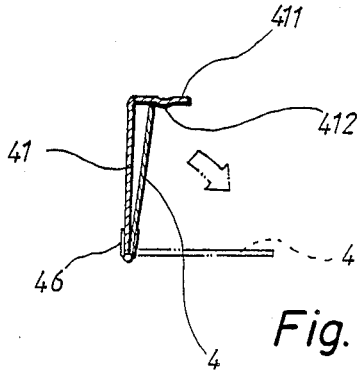
FIG. 5*a* is a sectional view, on an enlarged scale, of a fitting piece used on the tool rack of FIG. 5.

FIG. 5 illustrates another embodiment of the tool rack 4; one side of the seat 2 is furnished with several screw holes 26 corresponding to the screw holes 44 on the fitting pieces 41 on the tool rack 4 so as to let the screws 45 pass through for fixing the tool rack to the seat. The fitting pieces 41, as shown in detail in FIG. 5*a*, are coupled with the tool rack 4 by means of hinges 46. Each top end of the fitting pieces 41 has a perpendicular piece 411, and the bottom side of that perpendicular piece has a bead-shaped portion 412, whereby the tool rack 4 can be held in a folded position when not in use.

Figure 6:
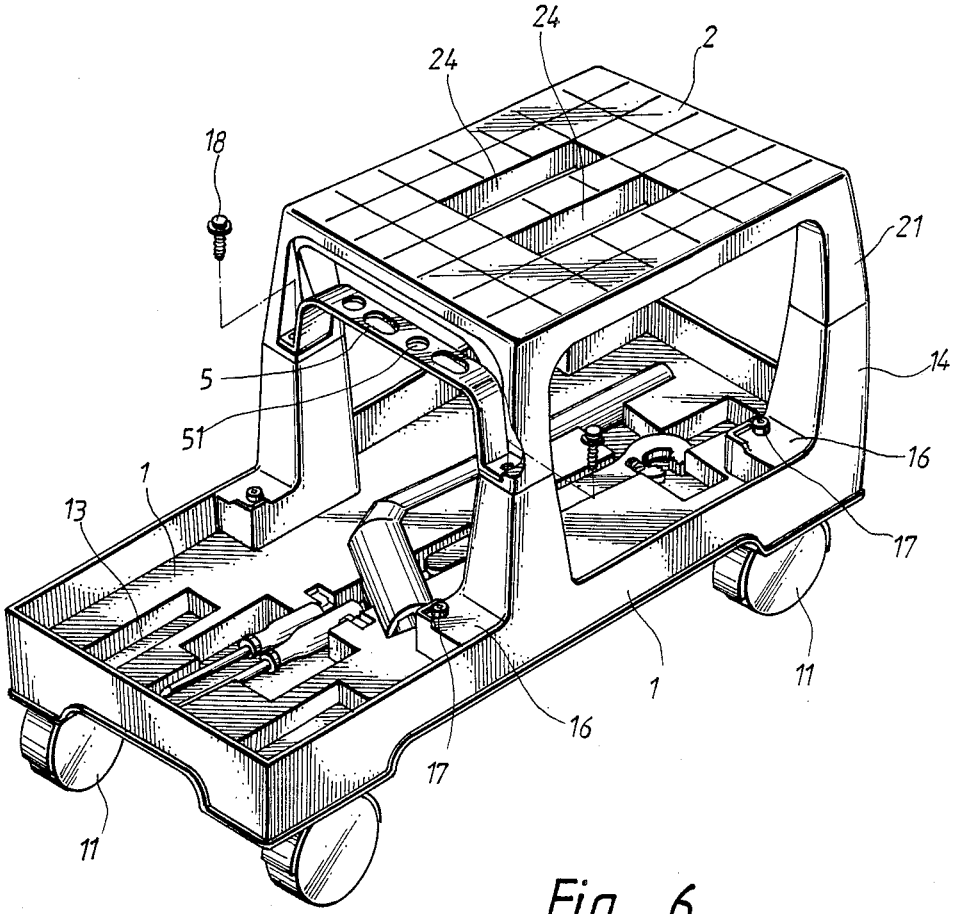
FIG. 6 is a perspective view of an embodiment of the present invention with a further added tool rack.

FIG. 6 is another embodiment of the present invention, in which another tool rack 5 is mounted between flanges 22 at one end of the seat 2. The tool rack 5 is fixed in place together with the seat 2 by means of screws 18; the tool rack 5 is furnished with through holes 51 for holding tools.

I claim:

1. A multi-function rack structure for carrying a jack, comprising:

a chassis, detachable casters mounted on the bottom of said chassis, said chassis having a top surface having grooves therein for accommodating therein parts of a jack and related tools, a plurality of abutments on the top surface of said chassis extending upwardly therefrom from positions spaced around said top surface, said abutments each having a top end surface and fastening means on said top end surface, said top surface of said chassis further having plane surface areas thereon at corresponding sides of each of said abutments and having fastening means thereon;

a seat having a plurality of legs depending from the bottom thereof, one at a position corresponding to each of said abutments and each having a bottom plane surface with a planar shape for engaging the top end surface of a corresponding abutment or the plane surface area at the side of the corresponding abutment and each having a fastening means thereon which can be mated with the fastening means on said top end surface of a corresponding abutment or the plane surface area at the side of the corresponding abutment, whereby said seat can have the legs on the abutments to function as a high stool or can have the legs on the plane surface areas to function as a storage means for the jack or as a low stool.

2. A multi-function rack structure as claimed in claim 1 further comprising a tool rack mounted on said seat and extending laterally thereof for receiving and holding tools.

3. A multi-function rack as claimed in claim 2 in which said tool rack is mounted along an upper side portion of said seat.

4. A multi-function rack as claimed in claim 3 in which said seat has a plurality of holes spaced along the upper side portion, and said tool rack has a plurality of hooks therealong engagable in said holes for removably attaching said tool rack to said seat.

5. A multi-function rack as claimed in claim 3 in which said tool rack has a plurality of hinges along the length thereof with a hinge plate extending upwardly therefrom and attached to the upper side portion of said seat, each hinge plate having a perpendicular piece at the top edge thereof extending outwardly from said seat and having a bead on the under side thereof, said tool rack being pivotable upwardly about said hinges and having the free end engagable under said beads on said perpendicular pieces for being held in the upwardly pivoted position for storage.

6. A multi-function rack as claimed in claim 2 in which said tool rack has an inverted U-shape and has the opposite ends attached to adjacent legs adjacent the bottom plane surfaces thereof.

* * * * *